US007421237B2

(12) United States Patent
Funato et al.

(10) Patent No.: US 7,421,237 B2
(45) Date of Patent: Sep. 2, 2008

(54) IMAGE FORMING APPARATUS AND IMAGE FORMING METHOD

(75) Inventors: Hitoshi Funato, Kanagawa (JP); Kazuhiro Mori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 431 days.

(21) Appl. No.: 11/033,956

(22) Filed: Jan. 12, 2005

(65) Prior Publication Data

US 2005/0196204 A1 Sep. 8, 2005

(30) Foreign Application Priority Data

Mar. 8, 2004 (JP) ..... P 2004-063805

(51) Int. Cl.
*G03G 15/20* (2006.01)

(52) U.S. Cl. ..... 399/341; 430/124.11

(58) Field of Classification Search ..... 399/341; 430/124.13, 124.11

See application file for complete search history.

(56) References Cited

U.S. PATENT DOCUMENTS 5,235,393 A * 8/1993 Merle ..... 399/341
5,970,301 A * 10/1999 De Cock ..... 430/124.3
6,623,897 B2 * 9/2003 Tomita ..... 430/45.5
2001/0051057 A1 * 12/2001 Tomita ..... 399/67
2003/0207194 A1 * 11/2003 Tomita ..... 430/124
2003/0228180 A1 * 12/2003 Mitsuya et al. ..... 399/341
2004/0057741 A1 * 3/2004 Uehara et al. ..... 399/69
2004/0131403 A1 * 7/2004 Nakamura et al. ..... 399/341
2005/0226663 A1 * 10/2005 Behnke et al. ..... 399/341

FOREIGN PATENT DOCUMENTS

JP A-9-281830 10/1997
JP A-2002-91205 3/2002
JP A-2003-21978 1/2003

* cited by examiner

*Primary Examiner*—John L Goodrow
(74) *Attorney, Agent, or Firm*—Morgan, Lewis & Bockius LLP

(57) ABSTRACT

An image forming apparatus includes a fixing unit that heats and fixes a toner image created on a recording medium; and a cooling unit that cools the toner image heated and fixed by the fixing unit with reference to a melting point of wax contained in the toner image from a temperature higher than the melting point to a temperature lower than the melting point.

19 Claims, 8 Drawing Sheets

TEMPERATURE CHANGING RATE = -18 (°C/SEC)

GRADUAL COOLING BY AIR FLOW
IN THE VICINITY OF WAX MELTING POINT
(LOW GROSS = 18.5)

TEMPERATURE CHANGING RATE = -77 (°C/SEC)

GRADUAL COOLING BY OPEN AIR FLOW (30°C)
(LOW GROSS = 18)

TEMPERATURE CHANGING RATE = -122 (°C/SEC)

RAPID COOLING BY ROLLER CONTACT AREA IN THE VICINITY OF WAX MELTING POINT (HIGH GROSS = 21.9)

FIG. 8

FAN ROTATING SPEED TABLE

| KIND OF PAPER | ENVIRONMENTAL TEMPERATURE | | |
|---|---|---|---|
| | -14°C | 15-24°C | 25°C- |
| NORMAL SHEET 64-104gsm | $0m^3$/MIN | $0.5m^3$/MIN | $1m^3$/MIN |
| THICK PAPER NO. 1 105-157gsm | $1m^3$/MIN | $1.5m^3$/MIN | $2m^3$/MIN |
| THICK PAPER NO. 2 158-260gsm | $2m^3$/MIN | $2.5m^3$/MIN | $3m^3$/MIN |

IMAGE FORMING APPARATUS AND IMAGE FORMING METHOD

BACKGROUND OF THE INVENTION

1. Field of the Invention

This invention relates to an image forming apparatus using e.g. an electrophotographic system, and more particularly to an image processing apparatus for heating and melting a toner image formed on a recording medium so that it is fixed on the recording medium.

2. Description of the Related Art

In an image forming apparatus such as a printer or a copier using an electrophotographic system, an electrostatic latent image is formed on the surface of an image carrier of a drum or belt-shaped organic photosensitive material through a known electrophotographic process. Thereafter, the electrostatic latent image is developed using toner to provide a toner image. Subsequently, the toner image is electrographically transferred on a recording medium (paper sheet) directly or through an intermediate transfer body. Thereafter, the toner image is fixed on the recording medium by e.g. a heating and fixing mechanism, thereby forming an image. This heating and fixing mechanism includes a radiant system, a flash system, a two-roller system using a heating roller and a pressing roller, and a free-belt nipping system using the heating roller and a backup free belt. For example, in the two-roller system, a fixing portion is provided with a pair of rollers of a heating roller heated by e.g. a heater and a pressing roller covered with an elastic body. By passing the recording medium transferred with the toner image between the pair of rollers, the toner image not fixed is fixed onto the recording medium. In an image forming apparatus capable of forming a full-color image a four-color toner image of e.g. Y (yellow), M (magenta), C (cyan) and K (black) is duplicated on the recording medium. By passing the recording medium having the four-color toner image between the pair of rollers, the toner image is fixed on the recording medium, thereby forming the full-color image.

The toner employed for fixing such a full-color image is required to have high melting and mixing property when heat is applied, and is preferred to have high "sharp-melting property". On the other hand, the releasiablity of the toner from the heating roller and others is not sufficient. Particularly, the toner with high sharp melting property is likely to be offset onto the heating roller and others during fixing. In order to obviate such an inconvenience, conventionally, silicon oil was applied on the heating roller to improve the releasibility of the toner, thereby preventing the toner from being offset to the heating roller and others. However, in order to apply the oil such as the silicon oil on the heating roller, a device for supplying the oil must be provided separately. This complicates the image forming apparatus. In addition, it was also problematic that feeling of oil sticking on an exhausted recording medium is inevitable. In order to solve these problems, an apparatus was developed which forms an image using an oil-less toner making external supply of oil unnecessary instead of applying the silicon oil. In this oil-less toner, mould-releasing wax (hereinafter simply referred to as releasing wax) such as polyethylene wax, paraffin wax and silicon wax is added to the toner so that releasibility is given to the toner containing the coloring agent.

As related arts described in Patent Publications, for example, there is a technique for cleaning unwanted matter containing the wax component on the surface of the recording medium after fixing (for example, see JP-A-2002-91205 (Pages 4-5, FIG. 1)). Although not related to the problem for the releasing wax, there are some techniques for subjecting predetermined processing to the recording medium after fixing. For example, some techniques was developed for providing a cooling roller equipped with a large number of slots from which cooling wind is blown to paper (for example, see JP-A-9-281830 (Page 2, FIG. 1)). In order to solve the problem of occurrence of a striped area with low gloss on a recording sheet after the toner image has been fixed, the assignee proposed a technique for providing a plurality of air blowing slots between a fixing device and a transporting roller and blowing air on the toner image forming plane using a fan (see JP-A-2003-21978 (Pages 5-6, FIG. 2)).

Meanwhile, in the case where the oil-less toner described above is employed, generally, the gloss is lost because of the existence of wax. Nevertheless, in recent years, even where such wax is employed, high color-reproducibility and high gloss as in printing has been required as an image quality. Thus, in order to realize the image quality with high gloss, a technique for causing the toner to contain a wax of a material with a high melting property has been investigated. Further, by applying sufficient heat to the toner image in such a manner that thick paper of fine-quality such as "coated paper" is used as a recording medium and the speed (fixing speed) at which the recording medium passes a heating and fixing mechanism is slowed down, the high gloss image was acquired.

In an image forming apparatus provided with such a heating and fixing mechanism, in order to control the posture, traveling direction, exhausting direction, etc. of the recording medium having passed the heating and fixing mechanism, a contact member of e.g. a finger shape, brush shape or roller-shape is used.

However, particularly, in the case where the thick paper such as the coated paper is used, because of its low cooling speed, the toner image on the paper is also maintained at a high temperature. Thus, when the contact member is brought into contact with the recording medium after fixing, a contact mark called "rollermark" is produced on the toner image, resulting in image quality defect. Conventionally, such image quality defect was not a serious problem. However, for example, in the case where the gloss is required as in a photographed image and the image is formed on the entire surface of the recording medium, the image quality defect due to the roller mark becomes a problem.

Particularly, the image quality defect due to the roller mark is likely to occur in the color image with the toners of two or more colors superposed. The image quality defect is also conspicuous when using the toner doped with the releasing wax.

SUMMARY OF THE INVENTION

This invention has been made in view of the above circumstances and provides an image forming apparatus that improves the gloss even when the toner image after fixed contains wax.

Also this invention provides an image forming apparatus that cancels or suppresses the occurrence of image quality defect of partial change of gloss area even when the toner image after fixed contains wax.

Further, this invention provides an image forming apparatus that adjusts the gloss by subjecting the toner image after fixed to certain processing.

An image forming apparatus according to an aspect of this invention includes: a fixing unit that heats and fixes a toner image created on a recording medium; and a cooling unit that cools the toner image heated and fixed by the fixing unit with reference to a melting point of wax contained in the toner image from a temperature higher than the melting point to a temperature lower than the melting point.

BRIEF DESCRIPTION OF THE DRAWINGS

Embodiments of the present invention will be described in detail based on the following figures, wherein:

FIG. 8 is a table showing an example of the fan rotating speed table.

DETAILED DESCRIPTION OF THE IMVENTION

Now referring to the attached drawings, a detailed explanation will be given of an embodiment of this invention.

Figure 1:
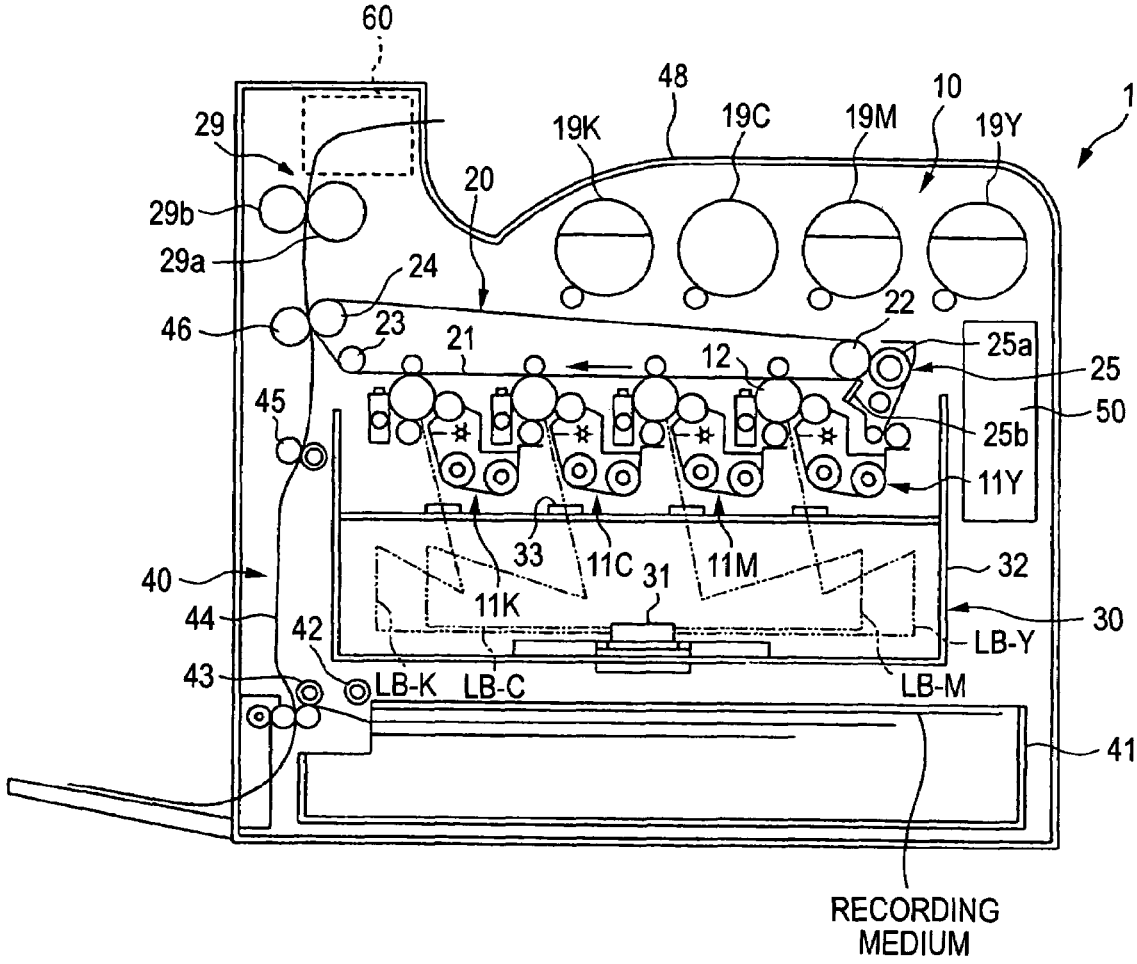
FIG. 1 is a view showing the entire configuration of the image forming apparatus according to an embodiment of this invention.

FIG. 1 is a view showing the entire configuration of the image forming apparatus according to this embodiment, and shows an "tandem-type" digital color printer. A body 1 of the image forming apparatus shown in FIG. 1 includes an image process system 10 for forming an image corresponding to the gradation data of each of colors, a sheet transporting system 40 for transporting a recording medium (sheet such as paper), an IPS (Image Processing System) 50 which is an image processing system connected to e.g. a personal computer or an image read device to subject predetermined image processing to image data received, and a cooling adjusting unit 60 for adjusting the gloss of a toner image after fixed which is a configuration characterizing this embodiment.

The image process system 10 includes four image forming units 11Y, 11M, 11C and 11K of yellow (Y), magenta (M), cyan (C) and black (B) which are horizontally arranged in parallel at regular intervals. The image process system further includes a transferring unit 20 for multiplex-transferring the toner image for each color formed on each of the photosensitive bodies 12 of these image forming units 11Y, 11M, 11C and 11K on an intermediate transferring belt 21, and an ROS (Raster Output Scanner) 30 which is an optical system for irradiating the image forming units 11Y, 11M, 11C and 11K with a laser beam. The body 1 further includes a fixing device 29 for fixing the image (toner image) secondary-transferred on the recording medium by the transferring unit 20 onto the recording medium using heat and pressure by means of e.g. a heating and fixing roller 29*a* and a pressing roller 29*b*. The body 1 further includes toner cartridges 19Y, 19M, 19C and 19K for supplying the toners of the respective colors to the image forming units 11Y, 11M, 11C and 11K.

The body of a color toner for the color to be supplied to each of the toner cartridges 19Y, 19M, 19C and 19K are made in such a manner that polyester resin, coloring agents (dyes or sublimed dyes), charging-control substances, etc. are molted/mixed, pulverized, classified and polymerized. In order to preferably duplicate the toner image formed on an image carrier onto an intermediate duplicator or recording medium, an additive with releasiablity can be added to the toner body. Taking the resistance to offset, fixing property and sharp-melting property into consideration, the color toner using polyester resin as binding resin is particularly preferable. Further, the toner used in this embodiment contains wax of e.g. 0.1 weight % to 40 weight %. Since the toner contains the wax, the wax serves as a releasing material. Thus, even where releasing oil is not applied on the surface of the heating and fixing roller 29*a* located in the fixing device 29, a wider fixing latitude can be assured. The fixing latitude means a temperature area from the temperature on the a low temperature side (lowest fixing temperature) at which a non-fixed toner image can be fixed on the recording medium when the temperature of the heating and fixing roller 29*a* is changed to the temperature on a high temperature side (offset generating temperature) at which the toner image cannot be released from the heating and fixing roller 29*a*.

When the toner contains the wax of 0.1 weight % or so, the offset generating temperature abruptly rises. If the content of the wax is further increased, the offset generating temperature gradually rises. On the other hand, the lowest fixing temperature gradually rises with an increase in the wax content. When the wax content exceeds 40 weight %, the lowest fixing temperature abruptly rises. Thus, the wax content of 0.1 weight % to 40 weight %, preferably 1 weight % to 10 weight % can realize a lower fixing latitude and a lower fixing temperature.

Further, the wax used has a melting point of e.g. 110° C. or lower, e.g. 80° C. to 100° C. The wax having the melting point lower to a certain degree than that of the binding resin in the toner can melt out earlier than the binding resin. Thus, when the toner is released at the exit of the nipping portion between the heating and fixing roller 29*a* and the pressing roller 29*b*, since the wax exists at the boundary between the toner and the heating and fixing roller, the releasing performance of the wax can be effectively improved.

The wax used for the toner in this embodiment is not particularly limited as long as it has releasiability. Concretely, the wax may be a plant wax such as a carnauba wax, cotton wax, haze wax and rice wax; an animal wax such as a bees wax and lanolin; a mineral wax such as ozokerite and ceresin; and a petroleum wax such as paraffin, microcrystalin and petrolatum. In addition to these natural waxes, a synthesized carbon hydride wax such as a fisher-tropsh wax and polyethylene wax; aliphatic acid such as 12-hydroxy stearateamide, stearate amide, phthalic anhydride imide and chlorinated carbon hydride; and synthesized wax such as ester, ketone and ether. Further, a crystalline high polymer resin having a low molecular weight may be crystalline high-polymer having a long acryl group on a side chain inclusive of homo-polymer of polyacrylate such as poly-n-stearyl methacrylate, poly-n-laurylmethacrylate, or its copolymer (e.g. copolymer such as n-stearylacrylate-ethylmethacrylate). Among these waxes, more preferable waxes are the petroleum wax such as paraffin wax, microcrystalin wax, or the synthesized wax.

The binding resin in the toner which is suitable to this embodiment is not particularly limited, but may be resin (polymer) generally used as the binding resin for the toner. More concretely, the binding resin may be polyester resin, styrene resin, acryl resin, styrene-acryl resin, silicon resin, epoxy resin, diene resin, phenol resin, ethylene-vinylacetate resin. The polyester resin is particularly preferable as described above. If the polyester resin is used as the binding resin, even when its molecular weight is great, an image with high surface smoothness and excellent transparency can be formed.

On the other hand, the transferring unit 20 includes a dive roller 22 for driving an intermediate transferring belt 21 which is an intermediate duplicator, a tension roller 23 for applying definite tension to the intermediate transferring belt 21, a backup roller 24 for secondary-transferring the superposed toner images of the respective colors on the recording medium, and a cleaning device 25 for removing the residual toners on the intermediate transferring belt 21. The intermediate transferring belt 21 is hung under define tension over the drive roller 22, tension roller 23 and backup roller 24. The intermediate transferring belt 21 is circulation-driven at a predetermined speed in a direction of arrow by the drive roller which is rotation-driven by a dedicated drive motor with an excellent constant speed characteristic. With the resistance regulated using a belt material (rubber or resin), the intermediate transferring belt 21 not occurring charge-up is employed. The cleaning device 25 is provided with a cleaning brush 25*a* and cleaning blade 25*b* and is designed so that the residual toners and paper particles after the transferring step of the toner image has been completed are removed from the surface of the intermediate transferring belt 21 for preparation for a next image forming process.

The ROS 30 is provided with a polygonal mirror 31 for deflection-scanning the laser beam (LB-Y, LB-M, LB-C and LB-K) emitted from a semiconductor laser in addition to the semiconductor laser and a modulator (not shown). In the example shown in FIG. 1, the ROS 30 is provided beneath the image forming units 11Y, 11M, 11C and 11K so that it may be soiled owing to drop of the toners or the like. In order to overcome this inconvenience, the ROS 30 is provided with a rectangular-parallelepiped frame 33 for sealing the respective components and a glass window 33 through which the laser beam (LB-Y, LB-M, LB-C and LB-K) passes and which is located at the upper position of the frame, thereby enhancing an shielding effect as well as scanning exposure effect.

The sheet transporting system 40 includes a paper feeding device 41 for feeding stacked recording media (sheets) on which the image is to be recorded, a Nudger roller 42 for feeding recording media taken up from the paper feeding device 41, a feed roller 43 for feeding the recording medium separated one by one from the recoding media supplied from the Nudger roller 42, and a transporting path 44 for transporting the recording medium separated one by one by the feed roller 43 toward an image transferring portion. The sheet transporting system 40 also includes a resist roller 45 for transporting the recording medium transported through the transporting path 44 in timing toward a secondary transferring position, and a secondary transferring roller 46 for secondary-transferring the image on the recording medium in pressure-contact with the backup roller 24 located at the secondary transferring position. The sheet transporting system 40 also includes an exhaust tray 48 for stacking the recording media with the toner images fixed by the fixing device 29 and exhausted via a cooling adjusting unit 60.

Next, an explanation will be given of the operation of the image forming apparatus shown in FIG. 1. A color material reflected image read by an original reading device (not shown) or a color material image data formed by a personal computer (not shown) is inputted to the IPS 50 as e.g. reflectance data of 8 bits for each of R (red), G (green) and B (blue). The IPS 50 subjects the reflectance data thus inputted to predetermined image processing such as shading correction, misregistration correction, brightness/color space conversion, gamma correction, frame erasure or various image editions such as color edition and movement edition. The image data thus image-processed are converted into four-color color substance tone data of yellow (Y), magenta (M), cyan (C) and black (B), and outputted to the ROS 30.

According to the color substance tone data thus inputted, the ROS emits the laser beam (LB-Y, LB-M, LB-C and LB-K) emitted from the semiconductor laser (not shown) toward the polygonal mirror 31 through an f-θ lens (not shown). The polygonal mirror 31 modulates and deflection/scans the incident laser beam according to the tone data of each color and the laser beam and projects the laser beam thus acquired onto the photosensitive drum 12 of each of the image forming units 11Y, 11M, 11C and 11K through an imaging lens and a plurality of lenses (not shown).

In the photosensitive drum 12 of each of the image forming units 11Y, 11M, 11C and 11K, its charged surface is scanning-exposed to form an electrostatic latent image. The electrostatic latent image thus formed is developed as the toner image for each of yellow (Y), magenta (M), cyan (C) and black (K) by each of the image forming units 11Y, 11M, 11C and 11K.

The toner image formed on the photosensitive drum 12 of each of the image forming units 11Y, 11M, 11C and 11K is multiplex-transferred on the intermediate transferring belt 21 which is an intermediate duplicator. In this case, the image forming unit 11K for black for forming the black toner image is located on the most downstream side in the traveling direction of the intermediate transferring belt 21 so that the black toner image is lastly primary-transferred on the intermediate transferring belt 21.

On the other hand, in the sheet transporting system 40, the Nudger roller 42 rotates in timing with the image forming so that the recording medium having a prescribed size is fed from the paper feeding device 41. The recording medium separated one by one is transported to the resist roller 45 by the feed roller 43 through the transporting path 44 and once stopped there. Thereafter, the resist roller 45 rotates in timing with the traveling timing of the intermediate transferring belt 21 with the toner image formed thereon so that the recording medium is transported to the secondary transferring position formed by the backup roller 24 and secondary transferring roller 46.

Onto the recording medium transported upward from a lower position at the secondary transferring position, the four-color multiplexed toner images are sequentially transferred in a sub-scanning direction using pressing force and a predetermined electromagnetic field. The recording medium with the toner image for each color transferred thereon is subjected to fixing processing by heat and pressure by the fixing device 29, and transported to the cooling adjusting unit 60. The cooling adjusting unit 60 performs the processing for improving the gloss and preventing occurrence of the roller mark for the recording medium and the recording medium is thereafter exhausted into the exhausting tray 48 provided at the upper part of the body 1.

An explanation will be given of the processing for improving the gloss and roller mark which is a configuration characteristic of this embodiment.

In the conventional apparatus using the wax as the releasing agent as described above, when the contact member arranged on the downstream side of the fixing device 29 is brought into contact with the recording medium after fixing, a contact trace called "roller mark" is generated on the toner image, which results in the image quality defect. The inventors of this invention have diligently tackled the problem of such image quality defect. As a result, the inventors have found the following two causes.

The first cause is physical unevenness. Namely, when the toner on the recording medium is brought into contact with the contact member in its soft state, unevenness occurs on the toner surface corresponding to the shape of the contact member so that the coarseness of the resultant contact trace reduces the gloss. Specifically, the gloss is decreased at the area with the unevenness and increased at the area with no unevenness so that when the toner on the recording medium is brought into contact with the contact member in its soft state, the roller mark is likely to occur.

The second cause is the problem of heat exchange. Namely, the inventors has found that when the fixed image at the area in contact with the contact member is rapidly cooled, a spot pattern due to fluctuation of the gloss occurs because of a difference of the cooling speed between the contact area and non-contact area.

In accordance with this embodiment, taking the above two causes into consideration, in order to suppress the image quality defect and adjust the gloss, the cooling control corresponding to the melting point of the wax was performed by the cooling adjusting unit 60.

Figure 2:
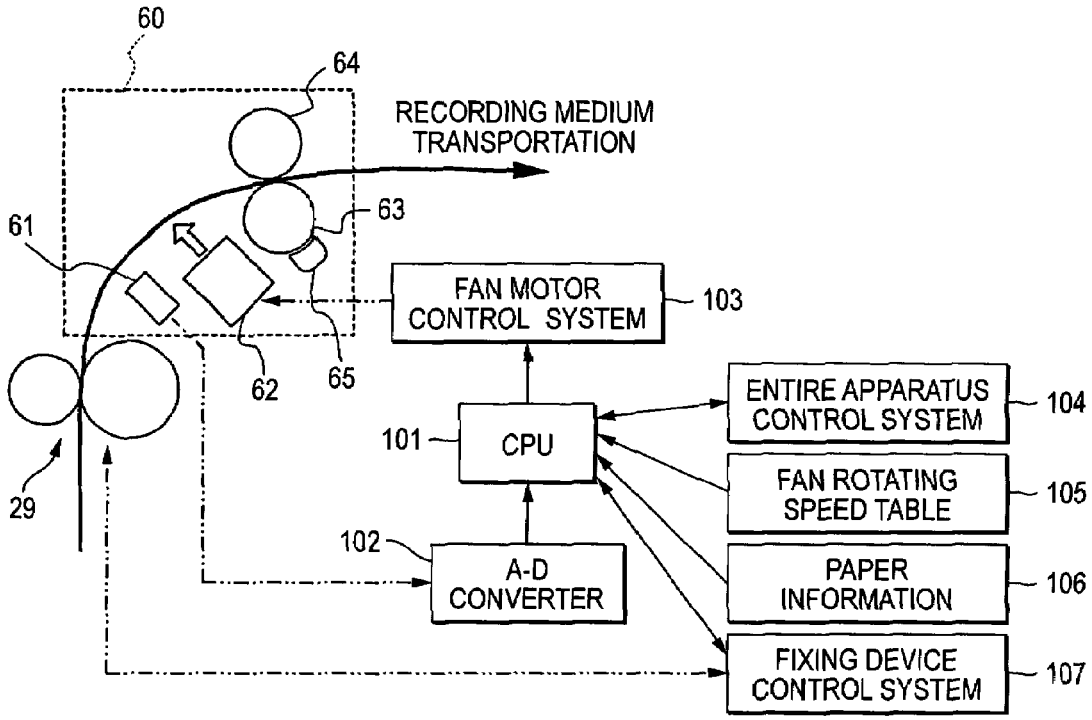
FIG. 2 is a view showing the configuration of a cooling adjusting unit and the control block for this cooling adjusting unit.

FIG. 2 shows the configuration of the cooling adjusting unit 60 and the control block for this cooling adjusting unit 60. The cooling adjusting unit 60 includes a temperature sensor 61 for measuring the temperature of the recording medium heated by the fixing device 29, a fan 62 for blowing air as required on the basis of the temperature measured by the temperature sensor 61 and transporting the recording medium adjusted to a predetermined temperature to the downstream side, a cooling roller 63 for rapidly cooling the toner image on the recording medium from a high temperature side in the vicinity of the melting point of the wax contained in the toner to a low temperature side in the vicinity thereof and a transporting roller 64 for transporting the recording medium in pressure-contact with the cooling roller 63. The cooling adjusting unit 60 may be provided with a heat dissipating member 65 for forcibly heat-dissipating the cooling roller 63. The blowing mouth of the fan 62 is designed so that a hose-like ventilating tube extended e.g. in a direction perpendicular to the direction of transporting the sheet is equipped with a large number of pores in the direction perpendicular to the transporting direction, thereby uniformly cooling the transported recording medium. The blowing mouth should not be limited to such a configuration. The heat dissipating member 65 is kept in contact with e.g. the cooling roller 63 to take heat therefrom, and exhausts the heat from the apparatus though a fin coupled with e.g. the heat dissipating member 65 on the IN side or OUT side of the body 1. Thus, the cooling roller 63 can be always kept at a low temperature.

The control system includes a CPU 101 for controlling the cooling adjusting unit 60, an A-D converter 102 for converting an analog value of the temperature obtained from the temperature sensor 61 into a digital value, and a fan motor control system 103 for controlling ON/OFF or revolving speed of the fan 62 under the control by the CPU 101. The control system further includes control blocks related to the control of the cooling adjusting unit 60, i.e. an entire apparatus control system 104 for controlling the entire apparatus of the body 1, a fan rotating speed table 105 for storing the information indicative of the relationship between the rotating speed of fan 62 and a temperature change according to e.g. the in-apparatus temperature, paper information 106 which is the information related to e.g. the weight and size of sheets of paper, presence/absence of coated papers, etc. stored in a predetermined memory, and a fixing device control system 107 for controlling the fixing device 29.

In this embodiment, the toner image on the recording medium is heated by the fixing device 29 at a fixing temperature of e.g. 160° C. which is higher than the glass transient point of the binding resin in the toner. Further, in the configuration shown in FIG. 2, the toner image is rapidly cooled in the vicinity of the wax melting point (e.g. 80 to 100° C.) which is lower than the above fixing temperature, thereby suppressing the crystallization of the wax and improving the gloss. For this purpose, before the toner image is brought into contact with the cooling roller 63, the surface of the toner image is cooled from 160° C. to the high temperature in the vicinity of the wax melting point (temperature in the vicinity of and higher than the wax melting point), and thereafter rapidly cooled by the cooling roller 63 to at least the low temperature in the vicinity of the wax melting point (temperature in the vicinity of and lower than the wax melting point). It is needless to say that the toner image may be cooled at a stretch to a further low temperature exceeding the low temperature in the vicinity of the melting point.

Figure 3:
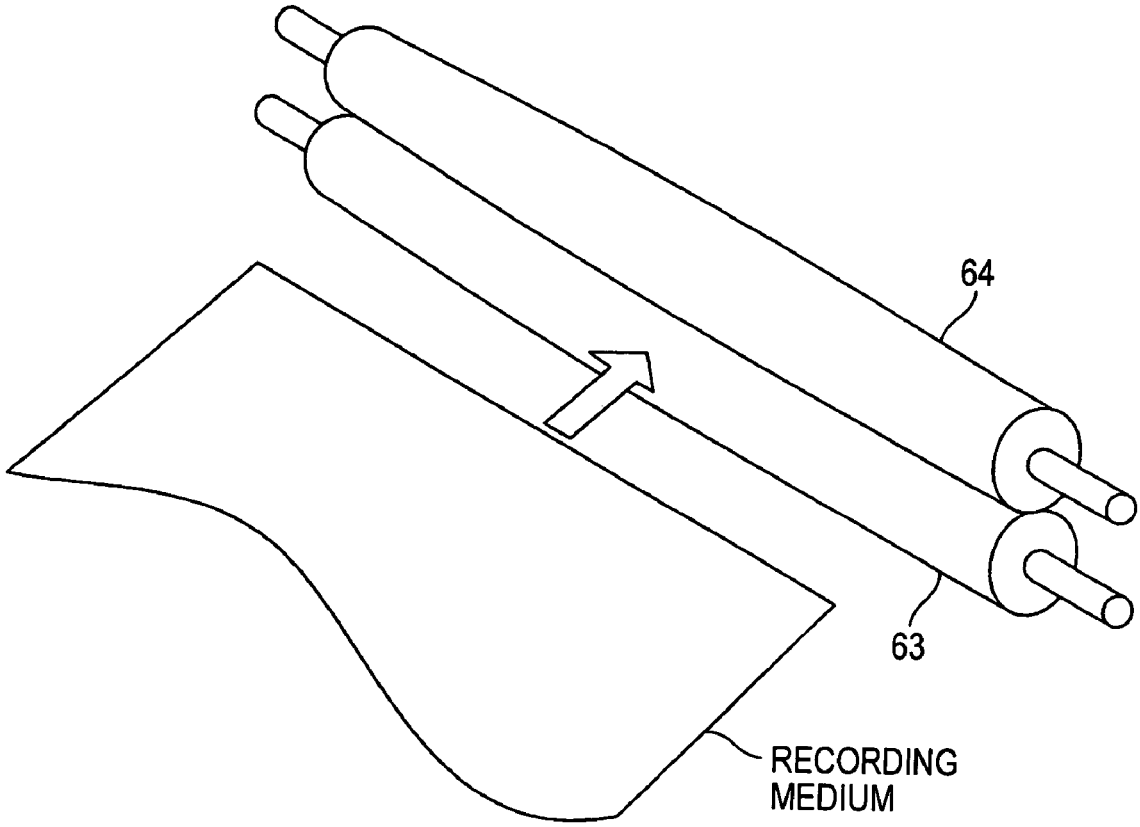
FIG. 3 is a perspective view of a cooling roller and a transporting roller.

FIG. 3 is a perspective view of the cooling roller 63 and transporting roller 64. Both the cooling roller 63 and transporting roller 64 are cylindrical rollers whose length is longer than the maximum width of the recording medium to be transported. These rollers have a length of e.g. about 338 mm. The cooling roller 63 with which the heated toner image is to be brought into contact may be a metallic roller of aluminum or SUS with high thermal conductivity, and is designed to be brought into uniform contact with the wax surface. On the other hand, the transporting roller 64 may be an elastic roller such as a rubber roller in order to improve the contact between the cooling roller 63 and the recording medium. The substance is e.g. silicon and EPDM. It is preferred that the cooling roller 63 and transporting roller 64 which constitute a pair are in uniform contact (pressing) with each other with no gap while nipping the recording medium. Even the small gap of e.g. about several tens ms is not preferable. At least one of the cooling roller 63 and transporting roller 64 (both cooling roller 63 and transporting roller 64, or one of the cooling roller 63 and transporting roller 64) is formed in a crown shape so that the diameter at the center is larger than the diameter on the axial side on both ends, thereby suppressing occurrence of the gap at the center due to the bending of the shaft. In an example of the crown shape designed by the inventors, the cooling roller 63 has the diameter of 10 mm at the center and the diameter of 9.858 mm at both ends whereas the transporting roller 64 has the diameter of 16.65 mm.

The recording medium having the toner image heated via the fixing device 29 reaches the nipping position of the cooling roller 63 and transporting roller 64 in a state on the high temperature side in the vicinity of the melting point of the wax contained in the toner. In the example shown in FIG. 3, while the toner image formed on the lower side of the recording medium is transported, it is successively rapidly cooled by the cooling roller 63. In this case, since the cooling roller 63 and transporting roller 64 are the cylindrical rollers, they are brought into uniform contact with the wax surface of the toner image. Thus, the wax surface of the toner image can be uniformly cooled, thereby suppressing occurrence of the unevenness on the surface of the toner image.

The releasing wax such as polyethylene added to the toner is a crystalline polymer, and its crystallization degree varies according to the manner of cooling. If the wax is rapidly cooled, its crystallization is not sufficient and hence the wax does not fall in an opaque state. On the other hand, if the wax is gradually cooled, its crystallization advances and the wax falls in a whitish state. The inventors have further investigated the influence of the cooling speed of the wax on the gloss. As a result, it has been found that with reference to the melting point of the wax, if the wax is rapidly cooled from the high temperature side higher than the melting point to the low temperature side lower than the melting point, the crystallization of the wax can be suppressed and the transparency can be enhanced, thereby improving the gloss.

Figure 4:
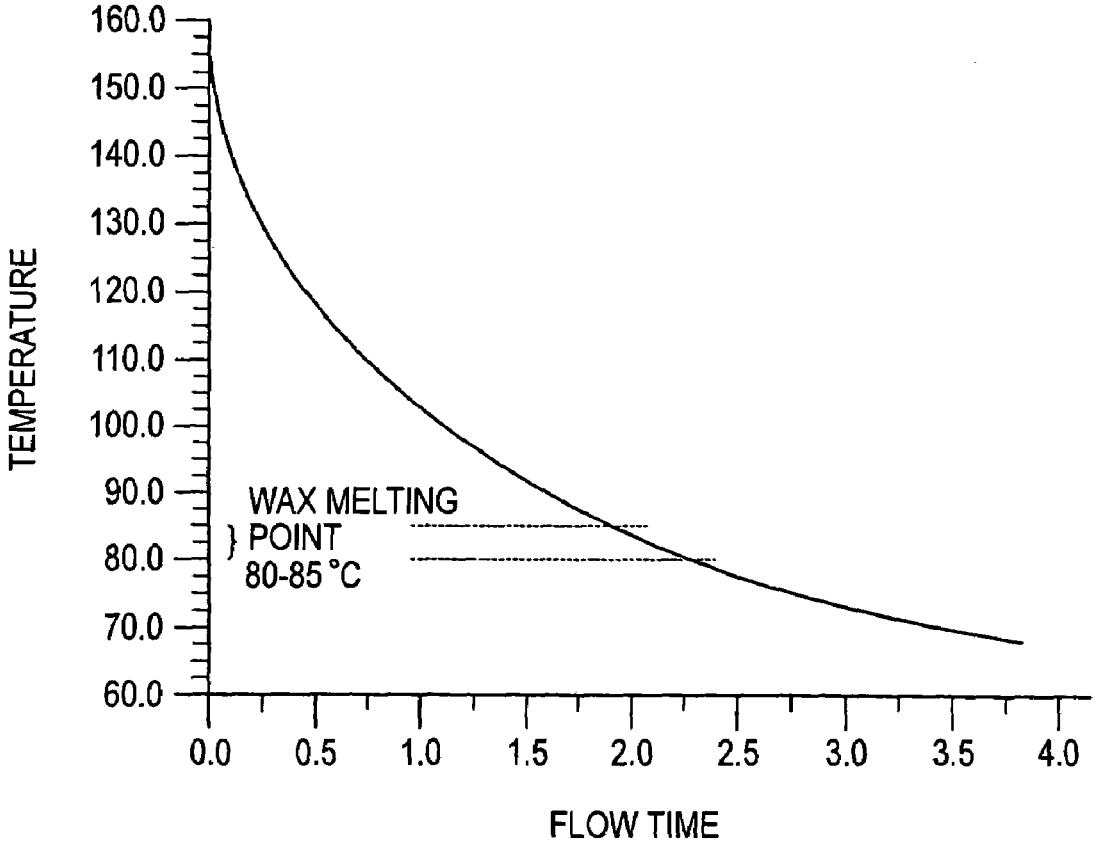
FIG. 4 is a graph showing an example of the case of gradual cooling using an air flow.
Figure 5:
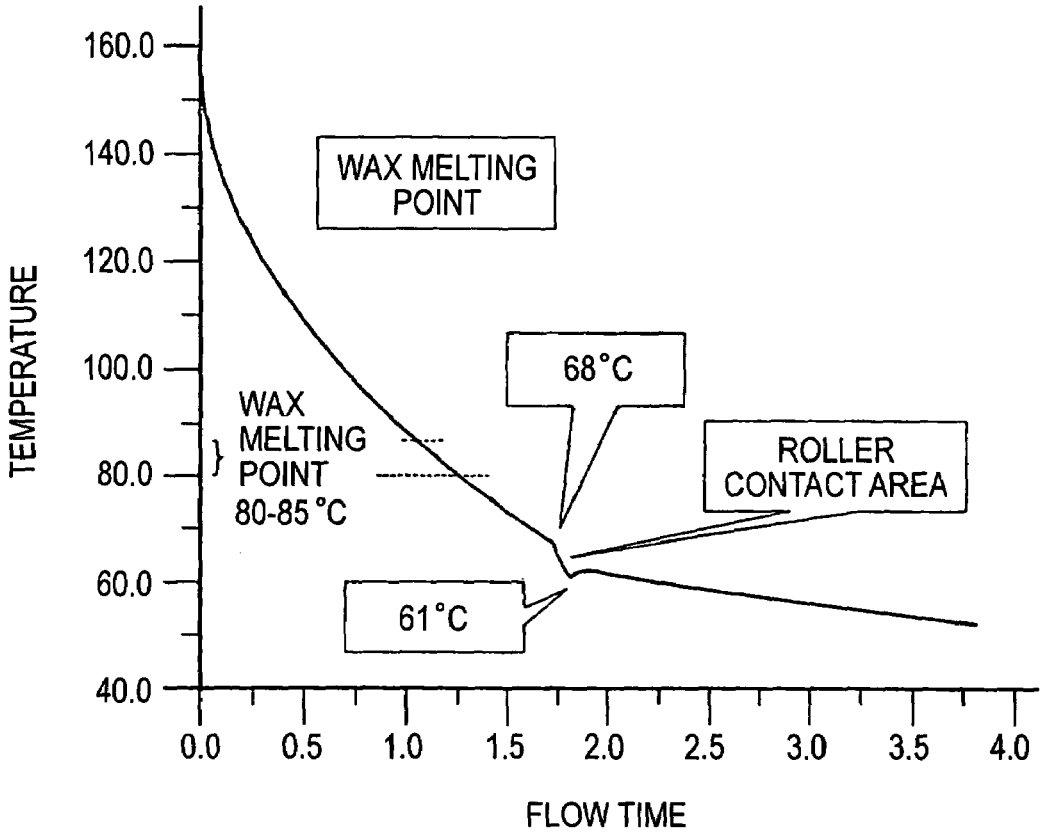
FIG. 5 is a graph showing an example of the case of gradual cooling using the open air flow (30° C.) at a temperature lower than a wax melting point.
Figure 6:
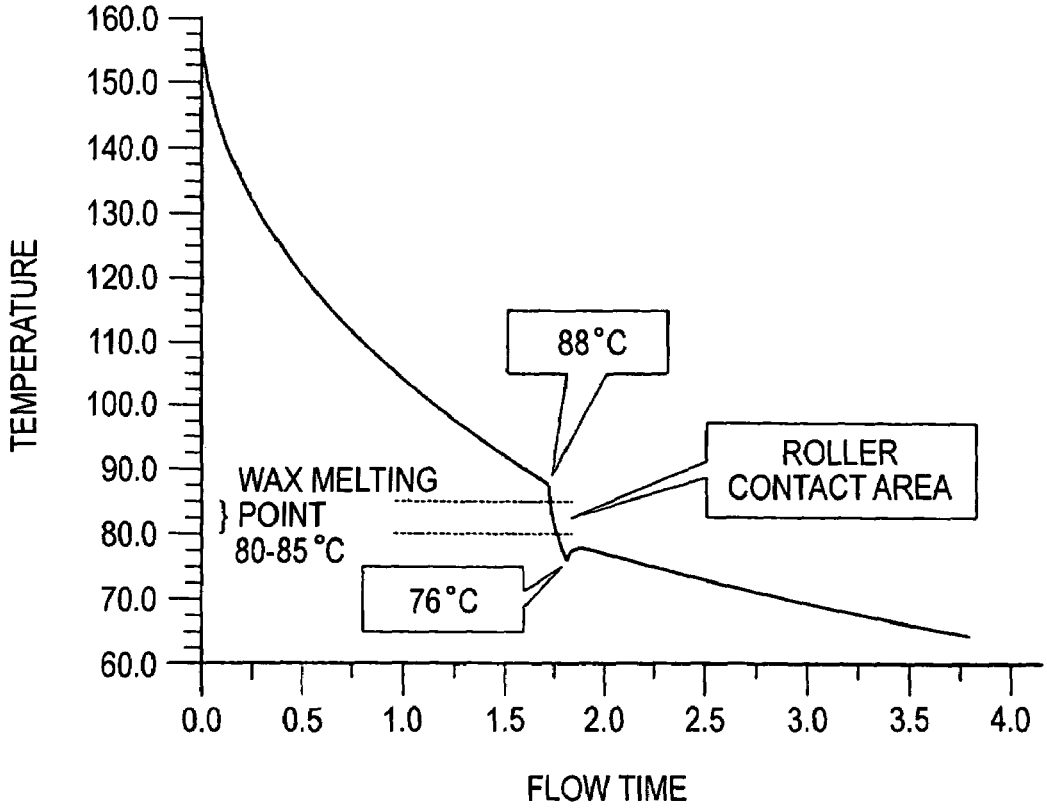
FIG. 6 is a graph showing an example of the case of rapid cooling in the vicinity of the wax melting point according to an embodiment of this invention.

FIGS. 4 to 6 are graphs for explaining the effect when the gradual cooling and rapid cooling are carried out in the vicinity of the wax melting point. It is now assumed that the toner with a wax melting point of 80 to 85° C. is employed. FIG. 4 shows an example of the case of gradual cooling using e.g. an air flow. FIG. 5 shows an example of the case of gradual cooling using the open air flow (30° C.) at a temperature lower than the wax melting point. FIG. 6 shows an example of the case of rapid cooling in the vicinity of the wax melting point according to this embodiment. In FIGS. 4 to 6, the horizontal axis represents a flow time, whereas the vertical axis represents a surface temperature of the toner image. In the example of FIG. 4, the temperature changing rate in the vicinity of the wax melting point is about −18° C./sec. The gloss at this time has been measured by the inventors. As a measurement jig, a 20 degree mirror gloss BYK, micro-TRI-gloss made by Gardner was employed to measures the 20 degree gloss. As a result of the measurement, in the example of FIG. 4, the value of the gloss was as low as 18.5. In the example of FIG. 5, although there is a region where the temperature changing rate is large (about −77° C./sec) at the temperature lower than the wax melting point, in the vicinity of the wax melting point, the temperature changing rate (about −18° C./sec) similar to that in FIG. 4 results. The toner image was gradually cooled in the vicinity of the wax melting point. The value of the gloss at this time was as low as 18 as in FIG. 4.

On the other hand, in the example shown in FIG. 6, the toner image is in contact with at its surface temperature of 88° C., and rapidly cooled from 88° C. to 76° C. With reference to the wax melting point of 80 to 85° C., the temperature range of 88 to 76° C. in the rapid cooling is a temperature range from the high temperature side higher than the wax melting point to the low temperature side lower than the wax melting point. In this case, the temperature changing rate is about −122° C./sec. When the toner image is brought into contact with the cooling roller 63 in the vicinity of the wax melting point, it is rapidly cooled. The gloss measured by the same method as described above is as high as 21.9. In short, by rapidly cooling the image fixed by the toner containing the wax as the releasing agent in the vicinity of the wax melting point, it is possible to suppress the crystallization of the wax and improve the gloss.

Figure 7:
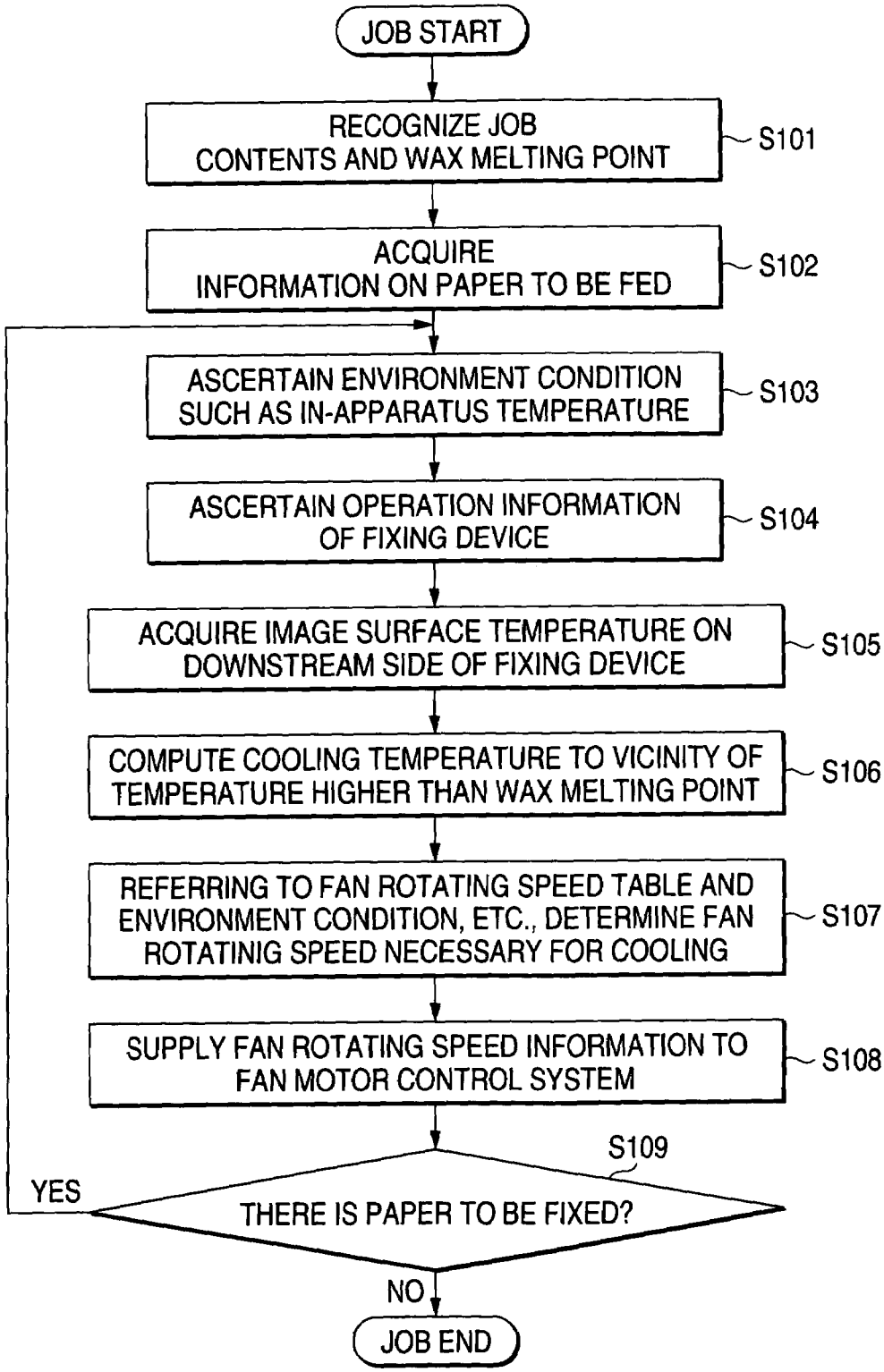
FIG. 7 is a flowchart of the processing executed by a CPU.

FIG. 7 is a flowchart of the processing executed by the CPU shown in FIG. 2. FIG. 7 shows a case of control using the fan 62 between the start and end of one job which is a series of image forming works. The CPU 101 recognizes the job contents and the melting point of the wax from the entire apparatus control system 104 (step S101). The job contents to be recognized are e.g. necessity of improving the gloss in a photographed image included in the original, unnecessity of improving the gloss because of a text-based original, color image or monochromatic image, etc. Further, the melting point of the wax is generally unique for the pertinent apparatus, and the melting point information stored in e.g. the ROM is uniquely readout. However, where a plurality of toners are employed, the corresponding values are different. If a different toner is used according to each job, e.g. the color image or monochromatic image, the information of the wax melting point stored in e.g. a ROM is read out for each job.

Next, the CPU 101 acquires the information (paper information) of the transported recording medium from the paper information 106 (step 102). The effect of the paper cooling depends on the thermal capacity determined by the basic weight of the paper and others. For example, the thermal capacity varies according to the thickness, density, presence/absence of a coated sheet and its substance. Therefore, even when the paper sheets are situated at the same temperature (e.g. about 160° C.) during the fixing, the succeeding temperature trace depends on the kind of the paper sheet. Specifically, the paper which is dense, thick, heavy and coated generally has a large thermal capacity, and hence take a long time for cooling. On the other hand, thin paper which has a small thermal capacity can be cooled in a moment. In view of such circumstances, in accordance with this embodiment, the information of the transported paper is acquired to implement the cooling control according to the paper.

FIG. 8 is a table showing an example of the fan rotating speed table 105 which is referred to by the CPU 101. In this example, the air flow supplied by the fan 62 is determined by a binary table consisting of an ambient temperature measured by an environment sensor (not shown) provided in the body 1 of the apparatus and the kind of paper. With an increase in the weight of paper from normal paper (64-104 gsm) to thick paper No.1 (105-157 gsm) and thick paper No.2 (105-157 gsm), the air flow (m3/min) is gradually increased. Namely, as described above, by cooling the paper having a larger thermal capacity with the air flow increased correspondingly, the temperature when the recording medium enters the cooling roller 63 is controlled to be within a predetermined temperature.

Thereafter, the CPU 101 ascertains the environmental condition such as an in-apparatus temperature (step S103) and the operation information of the fixing device 29 (step S104). Since the in-apparatus temperature greatly varies according to the environment where the body 1 is located and the contents of the job (e.g. early in the morning or not and continuous operation mode or not), it is desirable that the temperature is measured each time or at regular time intervals. The operation information to be ascertained of the fixing device 29 includes the information such as slowing down the speed at the fixing area for sufficient heating. The CPU 101 acquires, on the downstream side of the fixing device 29, the image surface temperature of the recording medium which has been measured by the temperature sensor 61 and digitized through the A/D conversion (step 105).

On the basis of these items of information, the CPU 101 computes the cooling temperature necessary to cool the image surface temperature of the recording medium to the vicinity of the temperature higher than the melting point of the wax contained in the toner (step S106). Thereafter, referring to the fan rotating speed table 105 as well as the environment condition and others, the CPU 101 determines the fan rotating speeds and others (step S107). Considering the distance from the measurement position by the temperature sensor 61 to the cooling roller 63, if natural cooling suffices the required cooling, forcible cooling by the fan 62 is not done. The CPU 101 supplies the fan rotating speed thus determined to the fan motor control system 103 (step S108). Thus, the fan 62 is operated by the output from the fan motor control system 103. Through this operation of the fan 62, the image surface of the recording media successively transported is cooled. Thus, the surface temperature of the image is adjusted immediately before the cooling roller 63 so as to be in the vicinity of the temperature higher than the wax melting point. Thereafter, it is determined whether or not there is paper to be fixed in the series of jobs (step S109). If there is the paper, the job is returned to step S103 to continue the same processing. If there is no paper, the job is ended.

Additionally, as illustrated in the flowchart of FIG. 7, this embodiment was adapted so that the forcible cooling by the fan 62 is performed. However, in place of the forcible cooling by the fan 62, for example, it is also efficient that the paper transporting speed between the fixing device 29 and the cooling roller 63 may be slowed down, thereby lengthening the time taken until the recording medium (paper) reaches. Without measuring the image surface temperature by the temperature sensor 61, the forcible cooling by the fan 62 may be performed on the basis of the information such as the kind and size of the recording medium and image forming mode.

Further, this embodiment may be extended so that the cooling speed of the toner image is changed in the vicinity of the melting point of the releasing wax contained in the toner, thereby positively adjusting the gloss of the toner image. More concretely, where it is preferable that the gloss is enhanced like e.g. the photographed image, as in this embodiment described above, the toner image is rapidly cooled in the vicinity of the melting point of the wax. On the other hand, where it is preferable that the gloss is low like a text image, the toner image is gradually cooled in the vicinity of the melting point of the wax. Whether the gloss should be increased or decreased can be determined automatically by the apparatus according the image forming mode and others, but can be determined on the basis of an instruction from a user. The method of gradual cooling can be implemented under the control by the CPU 101 in such a manner that the transporting speed of the recording medium after heated by the fixing device 29 is slowed down and all that while the toner image is gradually cooled using the fan 62, and when the surface temperature of the toner image becomes lower than the wax melting point the toner image is brought into contact with the cooling roller 63. Further, for example, the cooling roller 63 may be adapted to retract so that during the gradual cooling, it is detached from the transporting roller 64 so that it is not in contact with the toner image, and during the rapid cooling, it is kept in contact with the toner image. In this way, in accordance with this embodiment, by selecting the rapid or gradual cooling in the vicinity of the wax melting point, a new image forming method for adjusting the gloss of the toner image can be realized.

As understood from the detailed description made hitherto, in accordance with this embodiment, for example, where it is desirable to increase the gloss, the crystallization of the wax contained in the toner can be suppressed, thereby keeping the transparency.

Further, at the temperature lower than the melting point of the wax, by preventing the toner image from being in contact with the partial contact member which is in partial contact with a toner image like a general paper transporting roller, it is possible to annihilate striped image quality defect (roller mark).

As described above, an image forming apparatus according to an aspect of this invention includes: a fixing unit for heating and fixing a toner image created on a recording medium; and a cooling unit for cooling the toner image heated and fixed by the fixing unit with reference to a melting point of wax contained in the toner image from a temperature higher than the melting point to a temperature lower than the melding point. The wax employed here may be a releasing wax having a melting point lower than that of a toner body.

If the apparatus is characterized in that the cooling unit cools the toner image using a roller member sequentially brought into contact with the recording medium as the recording medium is transported, a high quality image with high gloss can be outputted with the small size and low cost of the apparatus being kept. Further, the roller member may be a cylindrical roller which is longer than the width of the recording medium in a direction orthogonal to the transporting direction of the recording medium. Further, the roller member may be made of a metallic material.

When taken from another aspect, this invention is an image forming apparatus for forming an image using a toner containing an ingredient having a melting point lower than a fixing temperature, including: a heating unit for heating a toner image transferred on a recording medium to a fixing temperature; and a cooling unit for cooling the toner image after it has passed the heating unit, wherein immediately before the toner image is cooled by the cooling unit, the surface temperature of the toner image is higher than the melting point.

If the apparatus is characterized in that immediately after the toner image has been cooled by the cooling unit, the surface temperature of the toner image is located on the side lower than the melting point, the crystallization of the ingredient having a low melting point can be suppressed, thereby providing the image with high gloss. Further, if the apparatus is characterized in that the cooling unit cools the toner image in a manner of being in contact with the surface of the toner image, the entire toner image can be uniformly cooled, thereby alienating the image quality defect.

When taken from still another aspect, the image forming apparatus to which this invention is applied includes: a fixing device for heating and fixing a toner image created by a recording medium; a contact member to be in contact with the toner image heated and fixed by the fixing device; and an adjusting unit for adjusting the temperature of the toner image so that before the toner image is brought into contact with the contact member, the temperature of the toner image is higher than the melting point of wax contained in the toner image, whereas after the toner image has been brought into contact with the contact member, the temperature of the toner image is lower than the melting point of the wax.

The apparatus can be characterized in that the adjusting unit adjusts the temperature using a predetermined air flow before the toner image is brought into contact with the contact member. Further, if the apparatus is characterized in that the adjusting unit measures a temperature in the vicinity of the toner image before the toner image is brought into contact with the contact member and adjusts the surface temperature of the toner image on the basis of the temperature in the vicinity of the toner image thus measured, this is excellent in that fine control can be made taking the ambient temperature, using status of the image forming apparatus, etc. into consideration.

The image forming apparatus according to another aspect of this invention includes: a fixing device for heating and fixing a toner image created by a recording medium; a contact member to be in uniform contact with the toner image heated and fixed by the fixing device and sequentially transported, in a direction orthogonal to the conveying direction; and an adjusting unit for adjusting the temperature of the toner image so that before the toner image is brought into contact with the contact member, the temperature of the toner image is close to but higher than the melting point of wax contained in the toner image.

The contact member may be a cylindrical metallic roller extending in a direction orthogonal to the transporting direction. Further, the apparatus can be characterized in that the adjusting unit adjusts the temperature of the toner image on the basis of information of the recording medium on which the toner image is formed.

On the other hand, the image forming method to which this invention is applied includes the steps of: heating a toner image containing a releasing wax so that it is fixed on a recording medium; and bringing a contact member into uniform contact with the entire surface of the toner image. Before being brought into contact with the contact member, a temperature of the toner image is kept to be higher than a melting point of the wax. The method can be characterized in that by bringing the contact member into uniform contact with the toner image, the surface temperature of the toner image is shifted to the side of the temperature lower than the melting point of the wax.

The image forming method to which this invention is applied includes the steps of: heating a toner image containing a releasing wax so that it is fixed on a recording medium; and adjusting the gloss of the toner image by changing the cooling speed of the toner image in the vicinity of the melting point of the wax. Now, the image forming method can be characterized in that in order to increase the gloss of the toner image, the toner image is rapidly cooled in the vicinity of the melting point of the wax, whereas in order to decrease the gloss of the image, the toner image is gradually cooled before and behind the melting point of the wax.

According to still another aspect of the invention, an image forming apparatus includes: a fixing unit that heats and fixes a toner image created on a recording medium; and a cooling unit that rapidly cools the toner image heated and fixed by the fixing unit with reference to a melting point of wax contained in the toner image from a temperature higher than the melting point to a temperature lower than the melting point.

The cooling unit may rapidly cool the toner image at a temperature changing rate of about −122° C./sec.

In accordance with this invention, even where the toner image after fixed contains wax, the gloss can be improved.

This invention can be applied to an image forming apparatus such as a printer or copier for forming an image using the toner containing wax, and an image forming method using the toner containing the wax.

The entire disclosure of Japanese Patent Application No. 2004-063805 filed on Mar. 8, 2004 including specification, claims, drawings and abstract is incorporated herein by reference in its entirety.

What is claimed is:

1. An image forming apparatus for forming an image using toner containing an ingredient having a melting point lower than a fixing temperature, comprising:

a heating unit that heats a toner image transferred on a recording medium to the fixing temperature; and a cooling unit that cools the toner image after it has passed the heating unit;

wherein immediately before the toner image is cooled by the cooling unit, a surface temperature of the toner image is located on a side higher than the melting point.

2. The image forming apparatus according to claim 1, wherein immediately after the toner image has been cooled, the surface temperature of the toner image is lower than the melting point.

3. The image forming apparatus according to claim 1, wherein the cooling unit cools the toner image while being in contact with a surface of the toner image.

4. An image forming apparatus comprising:

a fixing device that heats and fixes a toner image created on a recording medium;

a contact member to be in contact with the toner image heated and fixed by the fixing device; and an adjusting unit that adjusts a temperature of the toner image so that before the toner image is brought into contact with the contact member, the temperature of the toner image is higher than the melting point of wax contained in the toner image, whereas after the toner image has been brought into contact with the contact member, the temperature of the toner image is lower than the melting point of the wax.

5. The image forming apparatus according to claim 4, wherein the adjusting unit adjusts the temperature of the toner image using a predetermined air flow before the toner image is brought into contact with the contact member.

6. The image forming apparatus according to claim 4, wherein the adjusting unit measures a proximity temperature in the vicinity of the toner image before the toner image is brought into contact with the contact member and adjusts the temperature of the toner image on the basis of the temperature in the vicinity of the toner image thus measured.

7. An image forming apparatus comprising:

a fixing device that heats and fixes a toner image created on a recording medium;

a contact member to be in uniform contact with the toner image heated and fixed by the fixing device and sequentially transported, in a direction orthogonal to a transporting direction; and an adjusting unit that adjusts a temperature of the toner image so that before the toner image is brought into contact with the contact member, the temperature of the toner image is close to but higher than a melting point of wax contained in the toner image.

8. The image forming apparatus according to claim 7, wherein the contact member is a cylindrical metallic roller extending in a direction orthogonal to a transporting direction.

9. The image adjusting apparatus according to claim 7, wherein the adjusting unit adjusts the temperature of the toner image on the basis of information of the recording medium on which the toner image is formed.

10. An image forming method comprising the steps of:

heating a toner image containing a releasing wax to fix the toner image on a recording medium; and bringing a contact member into uniform contact with an entire surface of the toner image, wherein, before being brought into contact with the contact member, a temperature of the toner image is kept to be higher than a melting point of the wax.

11. The image forming method according to claim 10, wherein by bringing the contact member into uniform contact with the toner image, the temperature of the toner image is shifted to a temperature lower than the melting point of the wax.

12. An image forming method comprising the steps of:

heating a toner image containing a releasing wax to fix the toner image on a recording medium; and adjusting a gloss of the toner image by changing a cooling speed of the toner image in a vicinity of the melting point of the wax.

13. The image forming method according to claim 12, wherein in order to increase the gloss of the toner image, the toner image is rapidly cooled in the vicinity of the melting point of the wax, whereas in order to decrease the gloss of the image, the toner image is gradually cooled in the vicinity of the melting point of the wax.

14. An image forming apparatus comprising:

a fixing unit that heats and fixes a toner image created on a recording medium; and a cooling unit that rapidly cools the toner image heated and fixed by the fixing unit with reference to a melting point of wax contained in the toner image from a temperature higher than the melting point to a temperature lower than the melting point.

15. The image forming apparatus according to claim 14, wherein the cooling unit rapidly cools the toner image at a temperature changing rate of about −122° C./sec.

16. An image forming apparatus for forming an image using a toner containing a wax having a melting point lower than that of the toner, comprising:

a heating unit that heats a toner image transferred on a recording medium to the fixing temperature; and a cooling unit that cools the toner image after it has passed the heating unit;

wherein immediately before the toner image is cooled by the cooling unit, a surface temperature of the toner image is close to but higher than the melting point.

17. The image forming apparatus of claim 16, wherein immediately before the toner image is cooled by the cooling unit, a surface temperature of the toner image is less than or equal to 8 degrees C. higher than the melting point.

18. The image forming apparatus according to claim 16, wherein the cooling unit can not cool the toner image from a fixing temperature to a temperature lower than the melting point.

19. An image forming apparatus for forming an image using toner containing a wax having a melting point lower than that of toner, comprising:

a heating unit that heats a toner image transferred on a recording medium to the fixing temperature; and a cooling unit that cools the toner image after it has passed the heating unit;

wherein immediately before the toner image is cooled by the cooling unit, a surface temperature of the toner image is higher than the melting point but lower than melting point of toner.

* * * * *